US009861989B2

(12) United States Patent
Bell

(10) Patent No.: US 9,861,989 B2
(45) Date of Patent: Jan. 9, 2018

(54) FLUIDIZED BED SLUICE

(71) Applicant: Kevin P Bell, Gait, CA (US)

(72) Inventor: Kevin P Bell, Gait, CA (US)

( * ) Notice: Subject to any disclaimer, the term of this patent is extended or adjusted under 35 U.S.C. 154(b) by 0 days.

(21) Appl. No.: 15/355,701

(22) Filed: Nov. 18, 2016

(65) Prior Publication Data

US 2017/0209868 A1 Jul. 27, 2017

Related U.S. Application Data

(63) Continuation-in-part of application No. 14/829,928, filed on Aug. 19, 2015, now abandoned.

(60) Provisional application No. 62/039,122, filed on Aug. 19, 2014.

(51) Int. Cl.

| | |
|---|---|
| ***B03B 5/00*** | (2006.01) |
| ***B03B 5/26*** | (2006.01) |
| ***B03B 7/00*** | (2006.01) |
| ***B07B 1/04*** | (2006.01) |

(52) U.S. Cl.
CPC ..... *B03B 5/26* (2013.01); *B03B 7/00* (2013.01); *B07B 1/04* (2013.01)

(58) Field of Classification Search
CPC ..... B03B 5/26; B03B 7/00; B07B 1/04
USPC ..... 209/17, 18, 155
See application file for complete search history.

(56) References Cited

U.S. PATENT DOCUMENTS

| | | | | |
|---|---|---|---|---|
| 482,241 A | | 9/1892 | Gates | |
| 787,974 A | | 5/1908 | Klein | |
| 1,441,571 A | | 1/1923 | France | |
| 1,699,962 A | | 1/1929 | France | |
| 1,865,167 A | | 6/1932 | Bongera | |
| 2,065,967 A | | 12/1936 | Clark et al. | |
| 2,165,152 A | | 7/1939 | Pruss et al. | |
| 3,291,304 A | | 12/1966 | Fuchs | |
| 3,950,246 A | | 4/1976 | Klefisch | |
| 4,199,441 A | * | 4/1980 | Ross | B03B 5/66 209/44 |
| 4,253,943 A | * | 3/1981 | Thrasher | B03B 5/04 209/437 |
| 4,319,985 A | * | 3/1982 | Hibbard | B03B 5/26 209/3 |
| 5,244,099 A | * | 9/1993 | Zaltzman | A01D 33/04 209/466 |
| 5,255,787 A | | 10/1993 | Sims | |

(Continued)

*Primary Examiner* — Terrell Matthews
(74) *Attorney, Agent, or Firm* — Dean A. Craine

(57) ABSTRACT

A sluice including an upper channel that includes a material deck and a tilted classification screen. Below the classification screen is a lower cavity located between two longitudinally aligned plenums located under the upper channel. Each plenum includes a front opening and a rear opening and an interior sidewall. Extending between the plenums is a floor plate. Fluidization holes are formed on each interior sidewall. During use, the sluice is positioned in a stream so water flows simultaneously over the upper channel and the through the front openings of the plenums. Water flowing over the upper channel separates mined material placed on the material deck so that small particles fall through the classification screen. The water entering the front openings of the two plenums flows through the plenums and partially exits through the fluidization holes and sprays over the small particles deposited in the lower cavity further separating the fine gold particles from the small particles.

18 Claims, 7 Drawing Sheets

(56) References Cited

U.S. PATENT DOCUMENTS

| | | | | |
|---|---|---|---|---|
| 5,287,975 | A * | 2/1994 | Chumley | B03B 5/26 209/18 |
| 5,366,092 | A | 11/1994 | Schmidt, Sr. | |
| 5,476,177 | A | 12/1995 | Schmidt | |
| 6,216,367 | B1 * | 4/2001 | Tubbs | B03B 5/26 209/474 |
| 8,678,192 | B1 * | 3/2014 | Pung | B03B 5/26 209/18 |
| 9,132,431 | B2 * | 9/2015 | Alderson | B03B 5/26 |
| 2010/0236993 | A1 * | 9/2010 | Goodrich | B03B 5/26 209/44 |

* cited by examiner

FLUIDIZED BED SLUICE

This is a continuation in part application that is based on and claims the filing date priority of U.S. utility patent application Ser. No. 14/829,928, filed on Aug. 19, 2015, which is based on and claims the filing date priority of U.S. provisional patent Application No. 62/039,122, filed on Aug. 19, 2014.

COPYRIGHT NOTICE

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention relates to improved sluices designed to be placed in a stream of water that more efficiently separates the large particles from small particles and separates the fine gold particles from the small particles.

2. Description of the Related Art

It is common to place a sluice in a stream of water to prospect for gold. During operation, mined material is deposited onto the sluice which then uses the flow of water from the stream to separate the mined material into small particles. The water washes between and over the small particles to dislodge fine particles of gold. The fine gold particles are collected and removed from the sluice. The prospector must carefully monitor the flow of water through the sluice to make sure the sluice is operating properly and that any fine gold particles being collected and not washed away.

Ideally, prospectors want to use sluices that automatically separate the large and small particles, extracts the gold particles from the small particles and then deposits the fine gold particles in an area in the sluice less susceptible to be washed away. Unfortunately, sluices in the prior art do not efficiently separate the fine gold particles from small particles and require the sluice be removed from the stream and partially disassembled to collect the fine gold particles. The acts of continuously monitoring and removing the sluice from the stream, are burdensome and time consuming.

What is needed is an improved sluice that can be setup in a stream that efficiently separates fine gold particles from the mined material and the deposits the fine gold particles in areas or the sluice less susceptible to being washed away and allows the gold particles to be easily removed from the sluice without removing the sluice from the water.

SUMMARY OF THE INVENTION

Described herein is an improved sluice designed to more efficiently separate mined material into small particles and separate the fine gold particles from the small particles and then deposit the fine gold particles in a protected designated area where they can be easily collected without removing or dissembling the sluice from the stream. The sluice is a lightweight, two tier structure designed to be placed into a stream or a flowing main body of water. The sluice uses an upper layer of water and a lower layer of water from the stream. The upper layer of water first separates the large and small particles and then deposits the small particles into a lower cavity. The lower layer of water flows into the lower cavity and separates the fine gold particles from the small particles, and then deposits the fine gold particles in a designated area for easy collection.

More particularly, the sluice includes an upper channel comprising a material deck, an upward tilted classification screen, and an elevated, removable box cover. The upper channel has side plates that control the flow of water across the material deck, the classification screen and the box cover. The first stream of water enters the front opening of the channel adjacent to the material deck and then flows over the classification screen and over the box cover. Small particles fall through the classification screen and large particles flow over the channel's rear opening.

Below the upper channel is a lower tier made up of a two hollow plenums and a floor plate. The plenums are longitudinally aligned and parallel and extend under the mid line axis of the material deck to the box cover. Each plenum includes a front opening, a rear opening and two sidewalls. Formed on the interior sidewalls of each plenum are plurality of fluidization holes configured to spray a portion of the water that flows through each plenum laterally and onto the floor plate that extends transversely between the two plenums.

During operation, the sluice is placed in a stream sufficiently deep so that the upper layer of water in the stream flows over the material deck, the classification screen and the box cover. The stream must be sufficiently deep so the lower layer of water in the stream flows simultaneously through the front opening of each plenum. A water diverter is assembled in front of the front openings of the plenums that forces water into the front openings.

The plurality of fluidization holes are formed on each interior sidewall on each plenum configured to evenly spray water directly over the floor plate on opposite sides of the floor plate. When lower stream layer flows into the front openings of the plenums, much of the water exits the rear openings and a small portion of the water exits the fluidization holes. The water from the fluidization holes sprays over the small particles that fell through the classification screen and onto the lower cavity further separating the small particles into fine gold particles.

An optional collection tray can be placed over the floor plate and inside the lower cavity. The collection tray has low profile sidewalls that enable water from the fluidization holes to flow across collection tray from opposite directions. The top of the collection tray is open so excess water can flow around the collection tray and exit the sluice.

In the preferred embodiment, the box cover is movable on the sluice allowing the user to access the lower cavity or the collection tray.

DESCRIPTION OF THE PREFERRED EMBODIMENT(S)

Figure 1:
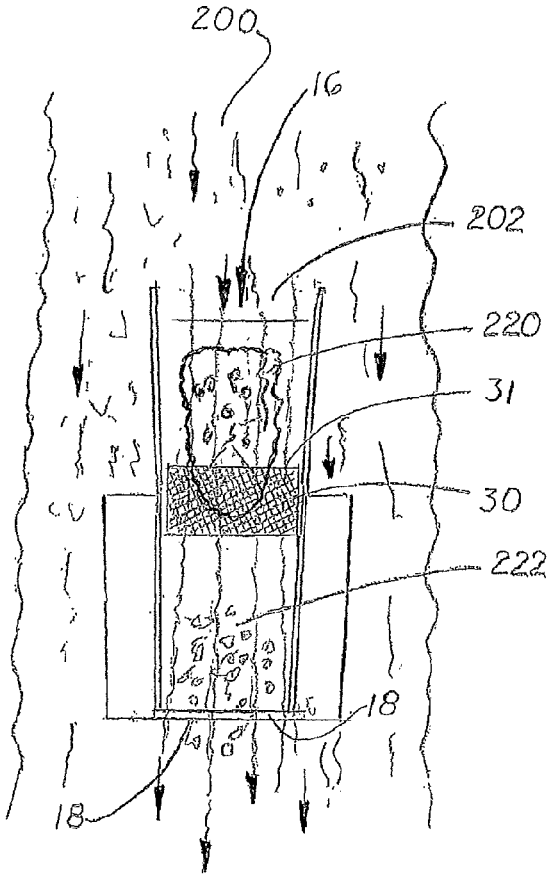
FIG. 1 is a top plan of the sluice.
Figure 2:
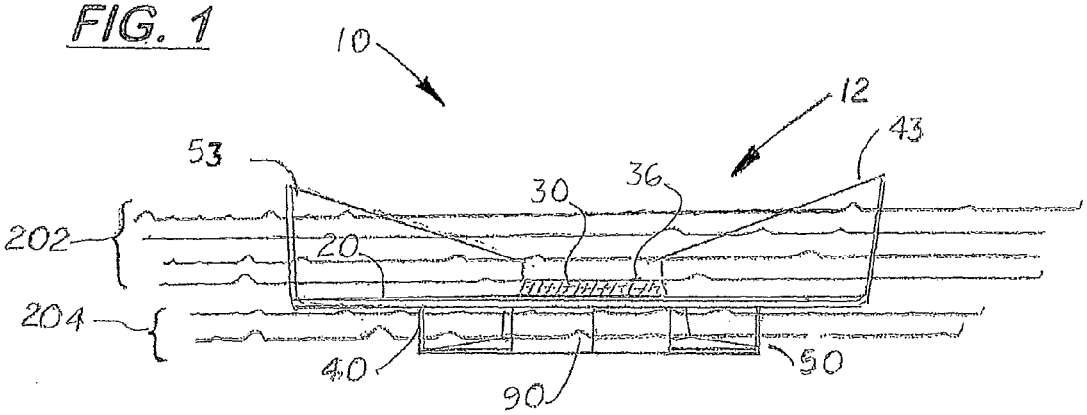
FIG. 2 is a front elevational view of the sluice in FIG. 1.
Figure 3:
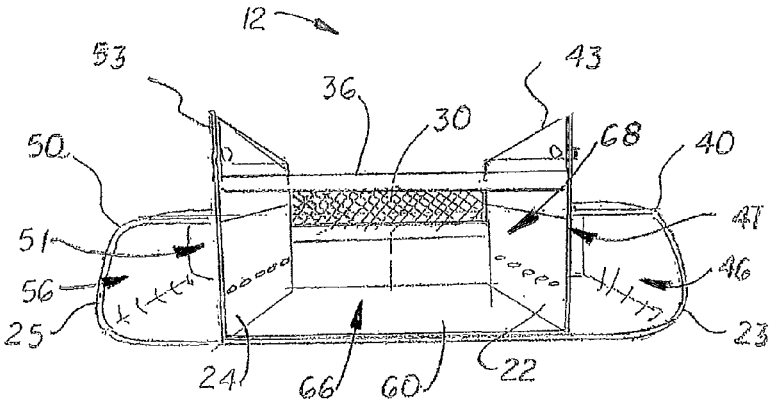
FIG. 3 is a rear elevational view of the sluice in FIGS. 1 and 2.
Figure 4:
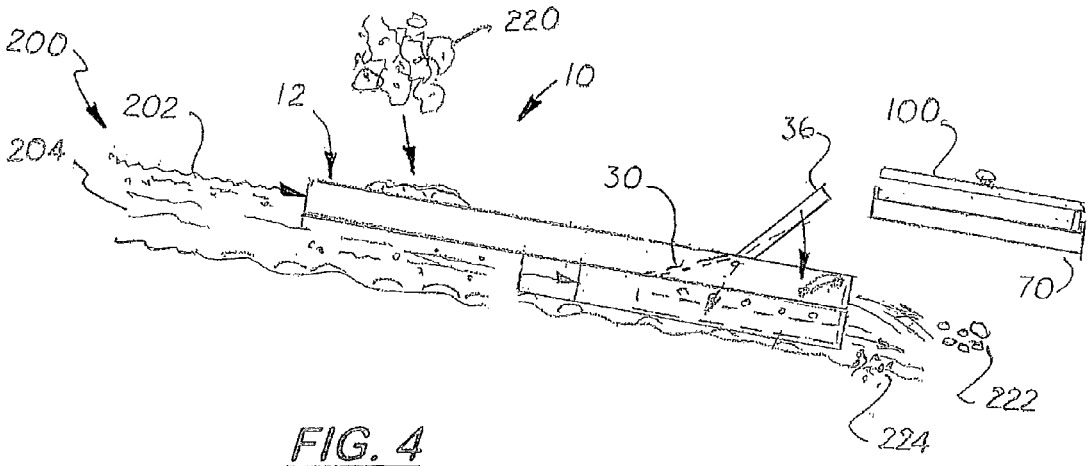
FIG. 4 is a side rear elevational view of the sluice in FIGS. 1-3.
Figure 5:
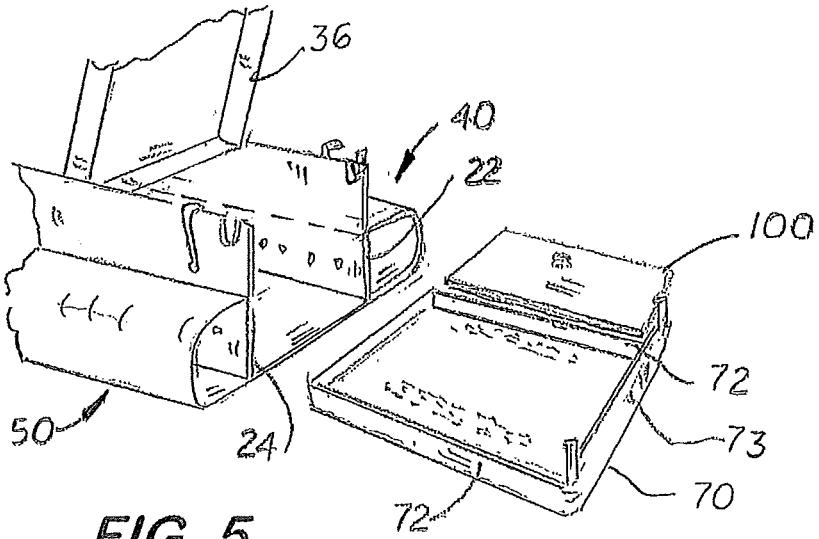
FIG. 5 is a top perspective view of the sluice and the removable collection tray.
Figure 6:
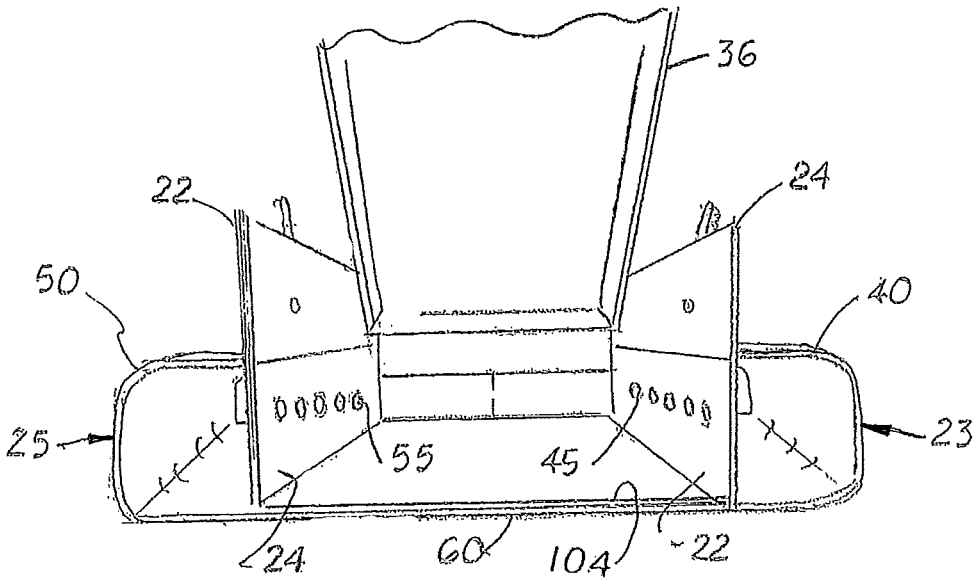
FIG. 6 is a rear elevation view of the sluice more clearly showing the rear opening and the fluidization holes.
Figure 7:
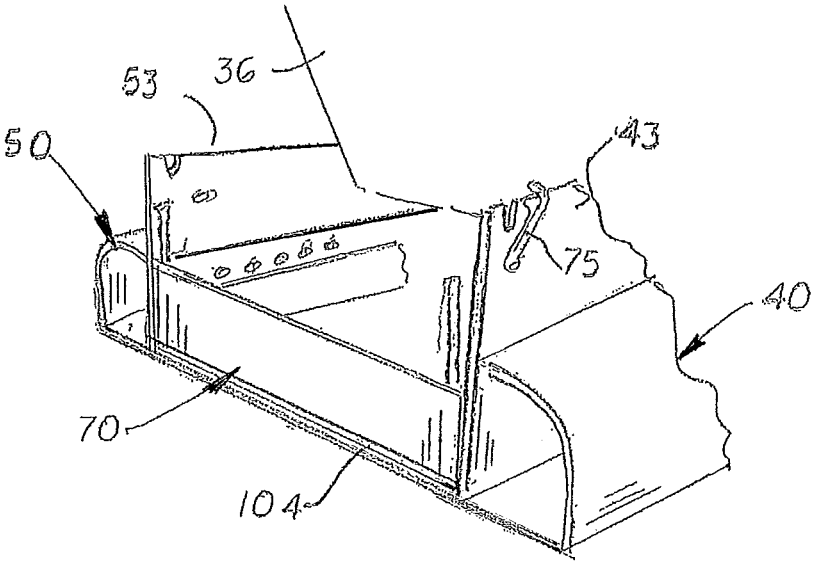
FIG. 7 is a top, rear perspective view of sluice with the collection tray placed inside the interior cavity and showing the cover raised.
Figure 8:
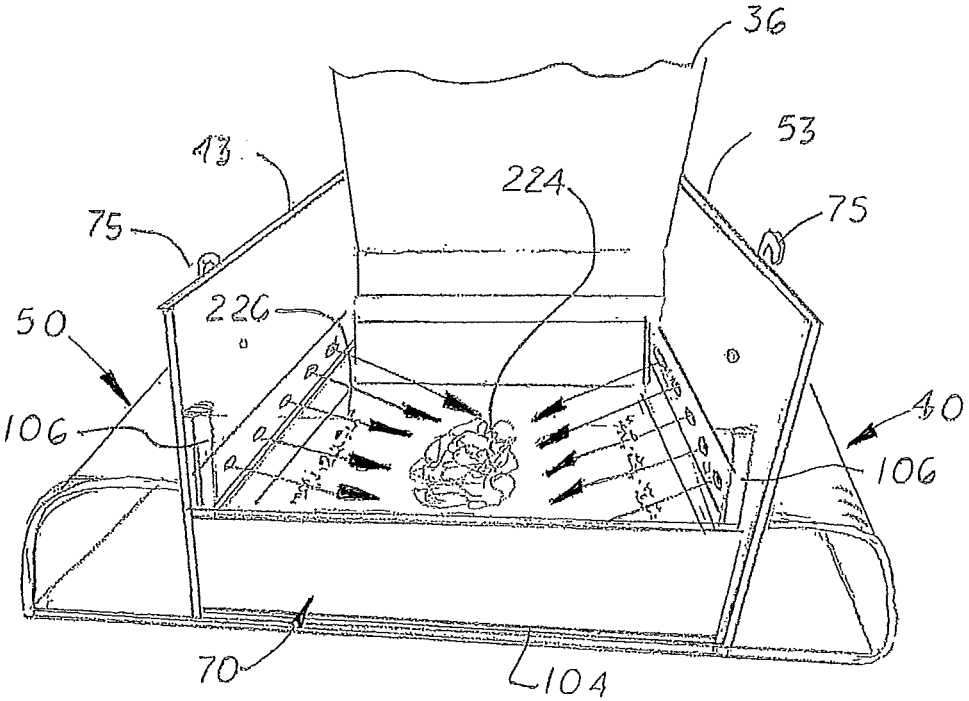
FIG. 8 is a top rear perspective view of the sluice showing the collection tray placed inside the interior cavity and showing the cover raised.
Figure 9:
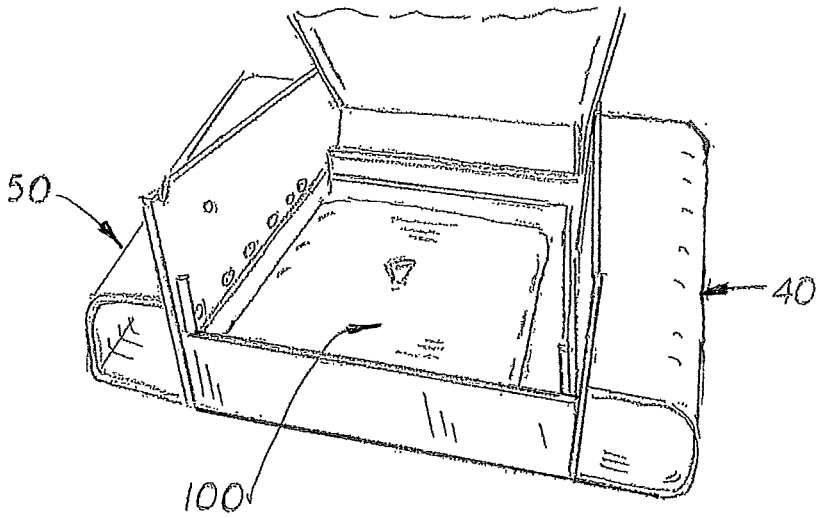
FIG. 9 is a top rear perspective view of the sluice with the collection tray positioned in the interior cavity and showing a tray cover placed over the collection tray.
Figure 10:
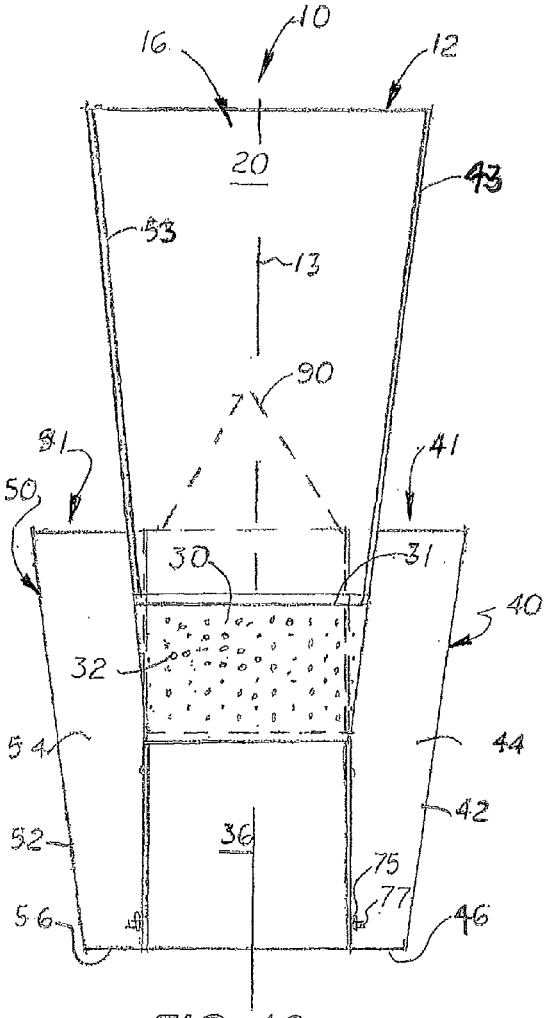
FIG. 10 is a top plan view of the fluidized bed sluice.
Figure 11:
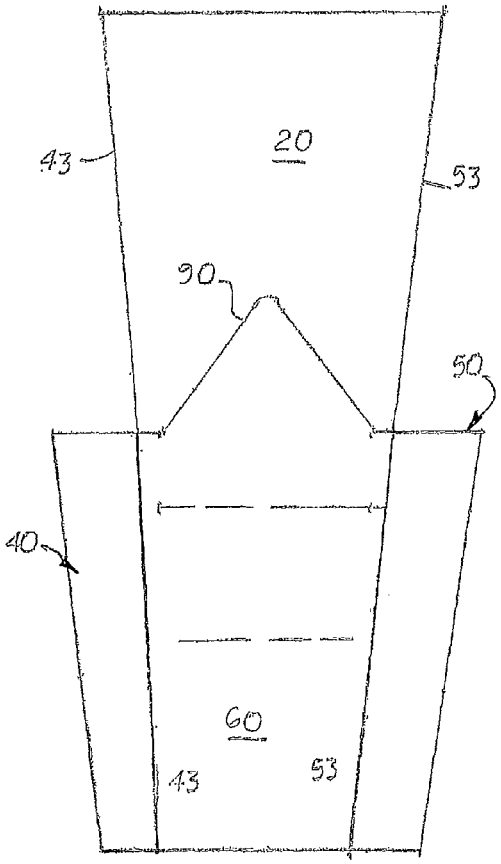
FIG. 11 is a bottom plan view of the fluidized bed sluice.
Figure 12:
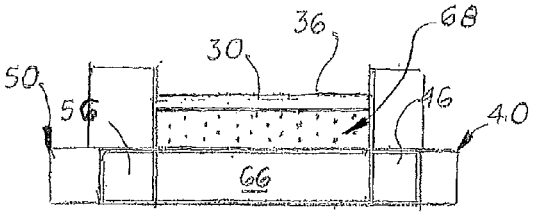
FIG. 12 is a rear elevational view of the fluidized bed sluice.
Figure 13:
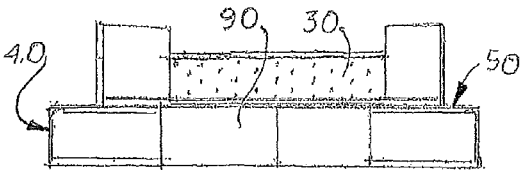
FIG. 13 is a front elevational view of the fluidized bed sluice.
Figure 14:
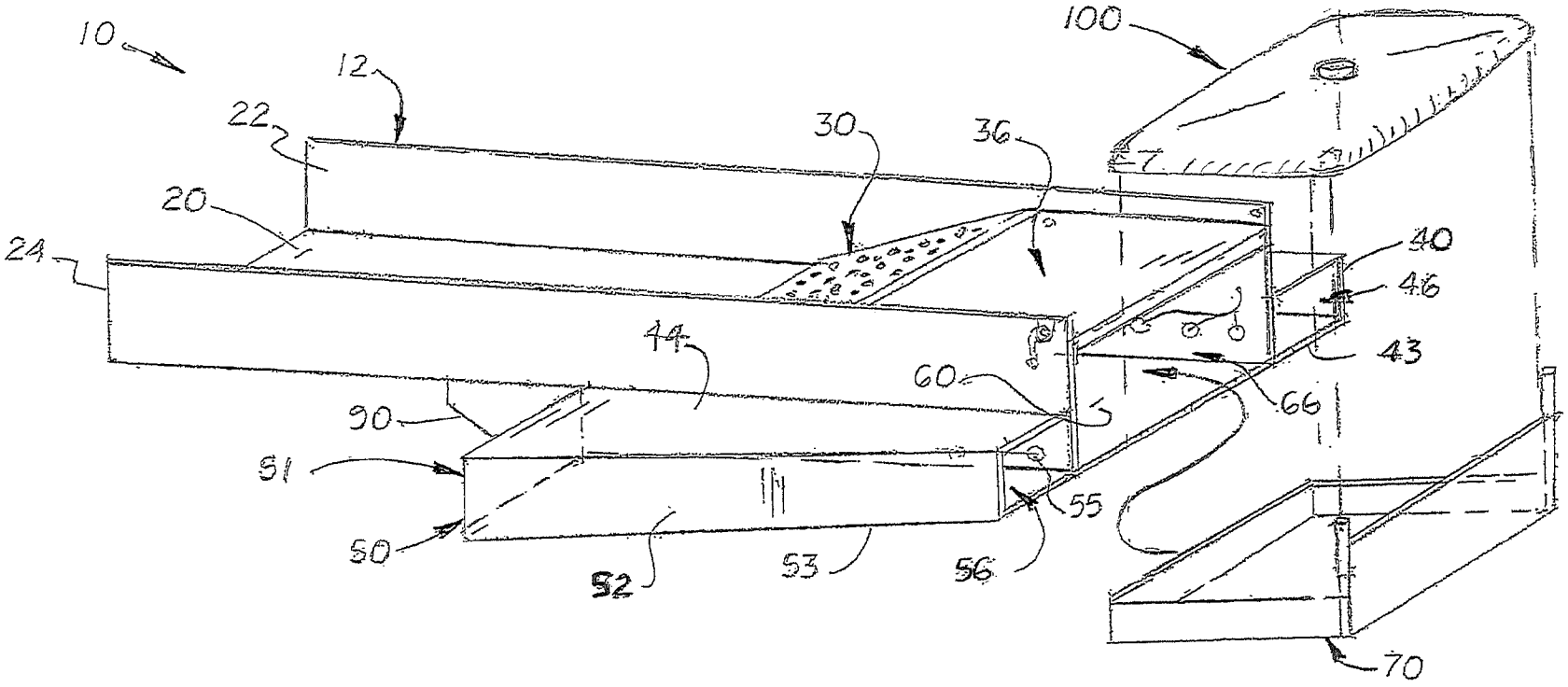
FIG. 14 is a side perspective view of the sluice system that includes fluidized bed sluice, the removable container tray and lid.

Referring to the Figs. there is shown a fluidized bed sluice 10 designed to be placed in a stream 200 or a flowing body of water. The sluice 10 is designed to operate more efficiently than sluices found in the prior art by separating the large and small particles 222, 224, respectively, in the mined material 220 using an upper layer of water 202 in the stream 200 and then using a lower layer of water 204 in the stream 200 to separate fine gold particles 226 from the small particles 224 and then deposit the fine gold particles 226 in a designated area for easy collection. During operation, the sluice 10 is placed into the main stream 200 sufficient in depth so that an upper layer of water 202 flows into the upper channel 12 and a lower layer of water 204 flows into the plenums 40, 50. The upper layer of water 202 flows over the mined materials 220 and separates into large particles 222 (greater than 5/16 inch in diameter) and the small particles 224 (smaller than 5/16 inch in diameter).

The upper channel 12 includes a material deck 20, an upward tilted classification screen 30, and a movable box cover 36. Formed on the opposite sides of the material deck 20, classification screen 30 and the box cover 36 are two side plates 43, 53 that form a continuous three-sided upper channel 12 through which the upper layer of water 202 flows. A front opening 16 and a rear opening 18 is formed on opposite ends of the upper channel 12. Below the classification screen 30 and the box cover 36 is a lower cavity 66 formed between two longitudinally aligned side plenums 40, 50 and a transversely aligned floor plate 60. Formed on the lower cavity 66 is an exhaust opening 68.

Each plenum 40, 50 includes a front opening 41, 51, a rear opening 46, 56, an interior sidewall 22, 24, an exterior sidewall 42, 52, a top panel 44, 54 and a bottom panel 45, 55, respectively. In the embodiment shown in the Figs, the plenums 40, 50 are longitudinally aligned under the upper channel 12, parallel, terminate under the rear opening 18 and extend forward ½ to ¾ the length of the sluice 10. It should be understood that each plenum 40, 50 may be circular or oval in cross-section, non-parallel and not longitudinally aligned with the upper channel 12.

A forward extending, triangular-shaped water diverter 90 is assembled in front of the front openings 41, 51, of the plenums 40, 50, respectively, that forces the lower layer of water 204 into each plenum 40, 50.

The rear edge 31 of the classification screen 30 is tilted upward approximately 20 degrees (actually a range between 17 to 22 degrees from the sluice's longitudinal axis) and a plurality of holes 32 are formed on the classification screen 30. During operation, small particles 224 travel through the holes 32 in the classification screen 30 and fall into a lower cavity 66. The large particles 222 are too large to travel through the holes 32 continue to move longitudinally over the box cover 36 and exit the upper channel 12 through the rear opening 18. In one embodiment, the holes 32 on the classification screen 30 are arranged in parallel rows and column. In one embodiment, the holes 32 are ¼ inches in diameter. In another embodiment, the holes 32 vary in diameter from ¼ to 5/16 inches. Larger diameter holes (5/16 inch) are used to increase the amount of water flow into the lower cavity 66. The number of larger diameter holes 32 on the classification screen 30 may also be varied to control the amount of water flowing into the lower cavity 66.

A plurality of fluidization holes 45, 55 are formed on the interior sidewall 22, 24 of each plenum 40, 50, respectively. In the embodiment shown in the Figs, five fluidization holes 45, 55 are formed on each interior sidewall 22, 24, respectively configured to spray water directly over the floor plate 60. The fluidization holes 45, 55 are approximately ½ inches in diameter, and one inches apart. When the lower layer of water 204 flows into the front openings 41, 51, of the plenums 40, 50, a large volume of the water exits the rear openings 46, 56 and a small volume exits the fluidization holes 45, 55, respectively. The water from the fluidization holes 45, 55 sprays over the small particles 224 deposited in the lower cavity 66 further separates the small particles 224 and the fine gold particles 226. Water from the holes 32 in the classification screen 30 and from the fluidization holes 45, 55 eventually flows outward through the exhaust opening 68. Because the fine gold particles are heavier than other fine particles the flow of water from the fluidization holes 45, 55 is directed transversely from opposite sides of the lower cavity 66 and causes turbulence causing the fine gold particles to separate from the other find particles and eventually settle forming a lower sedimentation layer on the floor plate 60.

During operation, the sluice 10 is positioned in the stream 200 so that upper layer of water 202 and the lower layer of water 204 flow simultaneously into the upper channel 12 and into the plenums 40, 50. The angle of the sluice's longitudinal axis 13 is adjusted to control the velocity of water flowing over the upper channel 12 and through the two plenums 40, 50.

An optional collection tray 70 can be deposited inside the lower cavity 66 and used to collect the small particles 224. The sluice 10 is designed so that the collection tray 70 may be selectively removed from the sluice 10 while the sluice 10 remains setup in the stream 200. The collection tray 70 has low profile sidewalls 72 and at a tall end plate 73. The low profile sidewalls 72 enable water from the fluidization holes 45, 55 to flow over the top edges of the sidewalls 72 in opposite directions. The top of the collection tray 70 is open so that excess water can flow around the collection tray 70 and exit the exhaust opening 68.

Operating Principles of the Subject Invention

The sluice 10 is placed into the bed of the stream of water 200. The longitudinal axis 13 of the sluice 10 is oriented downhill so that water enters the upper channel's front opening 16 and flows longitudinally over the upper channel 12. During operation, the upper layer of water 202 liquefies and stratifies materials with a higher specific gravity, primarily gold and black sand, from materials having a lower specific gravity. These materials are collected either as wetted material from the stream or other water source or as dry materials collected from digging outside or alongside the stream or other water source. The sluice 10 must be placed at an operating angle (between 2 to 10 degrees above the horizontal axis) to optimizing collection of desired materials and elimination of undesired materials. The front opening 16 of the upper channel 12 is placed just under the surface of the upper layer of water 202 and the rear opening 18 of the upper channel 12 is set with the water level half the height of the collection tray 70. This angle should be increased or decreased depending on the speed of water flow.

Characteristics and Innovations of Subject Invention

When prospecting, one objective is to separate the mined material 220 into large particles 222 (greater than ¼ inch in diameter) and small particles 224 (¼ inch in diameter or smaller). The small particles 224 are then further processed and the large particles 222 are discarded. The small particles 224 are then separated into smaller sizes according to their sedimentation properties in water. Because gold and black sand have a greater density than other common minerals, fine gold particles 226 (approximately 200 mesh size) settle in the bottom of the container. If the water flows at a sufficient rate, the fine materials with lower densities remain suspended in the water and exit the sluice.

More specifically, the sluice 10 is designed so that the surface area of the exhaust opening 68 is approximately 105% of the sum of the surface areas of the holes 32 in the classification screen 30 and the fluidization holes 45, 55. Since the holes 32 in the classification screen 30 must be ¼ and 5/16 inches in diameter, the number of holes in the classification screen 30, the size of the classification screen 30, the size and number fluidization holes are adjusted according to the surface area of the exhaust opening 68. This guarantees that waste materials and excess water exit the sluice 10 without restriction.

In normal operations, the sluice 10, the upper layer of water 202 flows into the upper channel 12 and over the material deck 20 to breakup, liquefy and move the mined material 220 over the classification screen 30. Part of the upper layer of water 202 (approx. 40%) pushes light material and material larger than the holes 32 in the classification screen 30 over the box cover 36 and through the rear opening 18. The largest percentage (approx. 60%) of the upper layer of water 202 flows through the classification screen 30 and into the interior cavity 66. Lighter materials are sucked into the exiting water flow and are expelled. This elimination of lighter materials is critical to maximizing the capture and retention of desirable materials and increasing material processed and lengthening the time between the removal of processed materials from the machine.

The lower layer of water 204 flows into the plenums 40, 50 creating a venturi effect increasing water velocity and suction. Water travels through the plenums 40, 50 and is forced through the fluidization holes 45, 55 at an equal pressure in each fluidization hole 45, 55 which agitates and stratifies the small particles 224 in the lower cavity 66 or in the collection tray 70. The equalization of pressure at each fluidization hole 45, 55 maintains constant fluidization and even distribution of materials in the tray without blasting holes or rows in the materials causing expulsion of materials that would normally remain fluidized in the collection tray 70. What is created is a gentle but thorough washing action that effectively eliminates waste materials while maintaining the heavier materials.

If a collection tray 70 is used and its capacity is reached, the collection tray 70 is removed from the lower cavity 66 and the concentrated material is emptied into a collection container (not shown). The emptied collection tray 70 is then returned into the lower cavity 66.

In the embodiment showing herein, the box cover 36 is pivotally mounted to the areas on the sidewalls 22, 24 adjacent to the classification screen 30. Optional locks 75 engage pegs 77 attached to the box cover 36 are used to hold the box cover 36 in place. The collection tray 70 is removed by first releasing the locks 75 and rotating the box cover 36, then placing the container tray cover 100 over the container tray 70 (eliminating the potential for water flow ejecting your concentrated material) and finally removing the collection tray 70 from the sluice 10 by lifting up on the rear edge of the collection tray 70 until the front of the collection tray 70 releases from the tray locking lip 104. Once the collection tray 70 is removed from the sluice 10, it is emptied then put back into the sluice 10 by sliding the front of the collection tray 70 back under the tray locking lip 104. The collection tray 70 then rests on the floor plate of the sluice 10 and the material tray cover 100 is lowered down onto the tray pins 106. This combination of the tray locking lip 102 and the tray pins 104 keeps the water flow from dislodging the container tray 70 and expelling it and the material from the sluice 10. The sequence of material processing, tray removal, emptying and container tray 70 back into the machine can be repeated indefinitely.

In compliance with the statute, the invention described has been described in language more or less specific as to structural features. It should be understood, however, that the invention is not limited to the specific features shown, since the means and construction shown comprises the preferred embodiments for putting the invention into effect. The invention is therefore claimed in its forms or modifications within the legitimate and valid scope of the amended claims, appropriately interpreted in accordance with under the doctrine of equivalents.

I claim:

1. An improved sluice, comprising:

a. an upper channel with a front opening and a rear opening, said upper channel includes two upward extending side walls, a material deck adjacent to said front opening, a classification screen located adjacent to said material deck and is tilted upward from said material deck, and a box cover located adjacent to said classification screen that extends to said rear opening;

b. two plenums longitudinally aligned and spaced apart under said upper channel and under said material deck, each said plenum includes an outer side wall, an interior side wall, a bottom surface, a front opening, a rear opening, and a plurality of fluidization holes formed on said interior side wall and under said material deck, said fluidization holes configured to deliver water flowing into said plenum laterally and towards the opposite plenum; and, c. a floor plate extending between said plenums and under said classification screen thereby forming a lower cavity under said classification screen configured to receive small particles of mined material that fall through said classification screen, said lower cavity also configured to receive water flowing through said fluidization holes, said lower cavity includes an exhaust opening enabling water to flow out of said lower cavity.

2. The improved sluice as recited in claim 1, further including a water diverter located between said plenums configured to divert water into said front openings of said plenums.

3. The improved sluice as recited in claim 1, further including a collection tray located inside said lower cavity and between said plenums, said collection tray includes low profile sidewalls each with a top edge with a height sufficient to allow water flowing through said fluidization holes to spray across mined material deposited in said collection tray and exit through said exhaust opening.

4. The improved sluice as recited in claim 2, further including a collection tray located inside said lower cavity and between said plenums, said collection tray includes low profile sidewalls each with a top edge with a height sufficient to allow water flowing through said fluidization holes to spray across mined material deposited in said collection tray and exit through said exhaust opening.

5. The improved sluice as recited in claim 1, wherein said box cover is pivotally attached to said sluice.

6. The improved sluice as recited in claim 3, wherein said box cover is pivotally attached to said sluice.

7. The improved sluice as recited in claim 1, wherein said fluidization holes are ½ inch in diameter.

8. The improved sluice as recited in claim 2, wherein said fluidization holes are ½ inch in diameter.

9. The improved sluice as recited in claim 3, wherein said fluidization holes are ½ inch in diameter.

10. The improved sluice as recited in claim 1, wherein said classification screen includes a plurality of holes ¼ inches in diameter.

11. The improved sluice as recited in claim 1, wherein said classification screen includes a plurality of holes ¼ inches and 5/16 inches in diameter.

12. An improved sluice with an with an upper channel that includes a front opening, a rear opening, two upward extending side walls, a material deck adjacent to said front opening, and a classification screen with a plurality of holes, located adjacent to said material deck; two plenums spaced apart longitudinally, located under and on opposite sides of said upper channel, each plenum includes a front opening and an interior wall with a plurality of fluidization holes formed thereon configured to redirect water that flows into said plenum inward and towards the opposite said plenum; and a floor plate located between said interior walls of said plenums and forming a lower cavity located between said plenum, said lower cavity configured to receive small particles that fall through said holes formed on said classification screen and receive water flowing through said fluidization holes on each said plenum, said floor plate also configured to receive water flowing through said fluidization holes.

13. The improved sluice as recited in claim 12, further including a water diverter located between said plenums configured to deliver water into said front openings of said plenums.

14. The improved sluice as recited in claim 12, further including a collection tray configured to be selectively placed into said lower cavity and configured to receive said small particles of mined material that fall through said classification screen and also configured to receive water through said fluidization holes.

15. The improved sluice as recited in claim 13, further including a collection tray configured to be selectively placed into said lower cavity and configured to receive said small particles of mined material that fall through said classification screen and configured to receive water through said fluidization holes.

16. The improved sluice as recited in claim 13, wherein said fluidization holes are ½ inch in diameter.

17. The improved sluice as recited in claim 12, wherein said classification screen includes a plurality of holes ¼ inches in diameter.

18. The improved sluice as recited in claim 12 wherein said classification screen includes a plurality of holes ¼ inches and 5/16 inches in diameter.

* * * * *